United States Patent [19]

Lee

[11] 4,022,933

[45] May 10, 1977

[54] WIRE ENAMELLING MACHINERY AND THE USE THEREOF

[75] Inventor: John Derek Lee, St. Helens, England

[73] Assignee: BICC Ltd., London, England

[22] Filed: Aug. 22, 1975

[21] Appl. No.: 606,974

[52] U.S. Cl. ..... 427/117; 118/DIG. 18; 118/DIG. 22; 118/67; 118/68; 118/125; 118/620; 118/404; 118/405; 427/120; 427/358; 427/388 R

[51] Int. Cl.[2] ..... B05D 5/12; B05D 3/12; B05D 3/02

[58] Field of Search ..... 427/117, 120, 358, 388 R; 118/DIG. 18, DIG. 22, 67, 68, 125, 404, 405, 620

[56] References Cited

UNITED STATES PATENTS

| | | | |
|---|---|---|---|
| 1,994,802 | 3/1935 | Adams | 118/DIG. 18 |
| 2,429,870 | 10/1947 | Dahlstrom | 118/DIG. 18 |
| 2,433,642 | 12/1947 | Bailey | 118/DIG. 18 |
| 2,575,911 | 11/1951 | Denham | 118/DIG. 18 |
| 2,825,091 | 3/1958 | Burley | 118/405 X |
| 3,346,413 | 10/1967 | Lindemann | 118/405 X |
| 3,412,709 | 11/1968 | Goyffon | 118/405 |
| 3,710,756 | 1/1973 | Goyffon | 118/405 X |

FOREIGN PATENTS OR APPLICATIONS

| | | | |
|---|---|---|---|
| 609,975 | 12/1960 | Canada | 118/405 |
| 1,346,907 | 2/1974 | United Kingdom | 118/405 |

*Primary Examiner*—Michael R. Lusignan
*Attorney, Agent, or Firm*—Buell, Blenko & Ziesenheim

[57] ABSTRACT

In a machine for coating wire with organic enamel, especially solventless enamel, an applicator (3) is placed at the top of a baking oven (5) and the wire (1, 7) passes downwardly through the applicator and oven. The applicator unit preferably forms part of the closure of the top end of the baking chamber. In an oven providing for a number of upward and downward passes of the wire, further applicators may be provided below the bottom of the oven to coat the upward passes.

18 Claims, 1 Drawing Figure

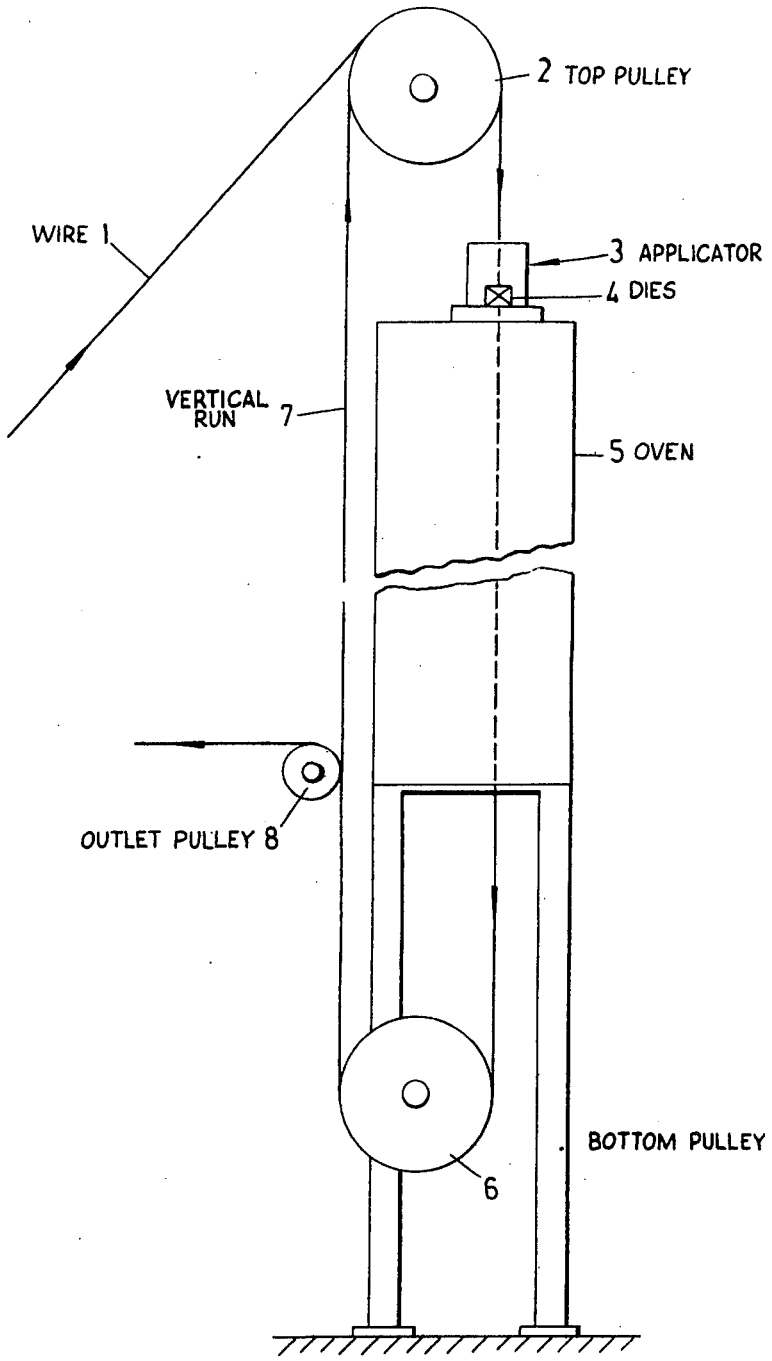
2 TOP PULLEY
WIRE 1
3 APPLICATOR
4 DIES
VERTICAL RUN 7
5 OVEN
OUTLET PULLEY 8
BOTTOM PULLEY
6

WIRE ENAMELLING MACHINERY AND THE USE THEREOF

This invention relates to machinery for the manufacture of enamelled wire (also known as film coated magnet wire) that is wire with an adherent film of organic insulating material. It relates primarily to apparatus having a vertical curing oven, hereinafter referred to as a "vertical enamelling machine," though it can be applied generally to any apparatus in which the wire path is significantly inclined to the horizontal.

In known vertical enamelling machines, a wire is passed upwardly through an enamel applicator unit and then through the baking chamber of an oven to a 'top' pulley above the oven, then downwards (normally outside the oven) to a 'bottom' pulley below the applicator from which it returns upwardly to a second applicator unit adjacent to the first, these components being repeated for each coat of enamel.

In accordance with the invention an enamelling machine comprises an oven, an applicator comprising at least one applicator unit mounted at the top end of the oven, preferably as part of a closure for the top end of the baking chamber of the oven but alternatively outside the baking chamber or in the upper part of it, and means for passing the wire at least once downwardly, preferably vertically, through the applicator unit and oven. Preferably the or each applicator unit includes a die removably mounted in the applicator, for example in a removable plate in the base thereof.

Normally there will be provision for enamelling a number of wires extending parallel to one another and normally also each wire will be passed round pulleys adjacent the upper and lower ends of the oven to pass through a number (e.g. 4 – 8) of adjacent units if the applicator (or of separate applicators) and on each pass through the oven, generally as in conventional enamelling machines. In some cases however it may be feasible to have a further applicator (or applicators) positioned below the bottom of the oven and to coat on at least one upward pass of the wire as well as on at least one downward pass. In this case the wire will of course pass through a baking chamber in each direction.

The machine in accordance with the invention can be used with any enamel that can be applied at an elevated temperature, but it is especially suitable for use with solventless enamels (or 'semisolventless' enamels containing only a small amount of solvent) at present in the course of development (see for example U.K. Pat. Specification No. 1346907) since these enamels must be applied hot to avoid solidification in the applicator. In such cases heat emanating from the oven may often heat the applicator to a temperature sufficient to melt the enamel but it is very desirable and may be necessary to control the temperature by auxiliary means, ordinarily by a controlled auxiliary heater though in some cases controlled cooling could be used.

The invention includes methods of enamelling wire, especially with solventless or semisolventless enamels, using the machinery as described.

Other advantages of this invention, applicable for all types of enamel, are:

1. the applicator, if of a suitable type and if mounted (as preferred) as part of a closure for the top end of the baking chamber seals the or each wire passage through the closure eliminating wasteful loss of hot gas at this point;
2. the wire approaching the applicator, usually over the top pulleys, is pre-heated to a useful extent (this effect is especially prominent of the applicator is inside the oven);
3. spilled enamel may be caught by the oven so that the risk of its falling on the bottom pulleys, as in conventional vertical machines, is greatly reduced and in favourable cases entirely eliminated;
4. the wire inlet to an applicator unit coating a descending wire need not be fluid-tight, since it faces upwards; and so it may be made of larger diameter to reduce risk of abrading any underlying coating on the wire; and
5. in some cases only the lower part of the oven needs to be heated, the upper part receiving heat from below.

When the invention is put into operation by modification of existing vertical enamelling machines, the wire source (for example a supply stand or a wire-drawing machine) and take-up mechanism will often be located at ground floor level, that is about the level of the bottom pulleys, and two operators may be required, one to supervise the applicators and the other the source and take-up. It may in some cases be preferable for the source and take-up to be located at about the level of the applicators, and this may be achieved e.g. in new plant, by sitting them on an upper floor of a suitable building or by excavating to place a major part of the oven below ground level.

The invention will be further described, by way of example, with reference to the accompanying FIGURE which is a diagrammatic end elevation of a vertical enamelling machine in accordance with the invention.

Wire 1, taken from a conventional reel stand or direct from a suitable wire-drawing machine (preferably in accordance with our U.S. Pat. No. 1305032) runs over a top pulley 2 and passes downwards through an applicator 3 in the form of an open-topped trough having a series of dies 4 in its base. The wire passes downwards through one of the dies 4 and emerges from it directly into the interior of the oven 5 which is heated in a conventional manner except that preferably the lower part is heated to a higher temperature than the upper part, instead of the other way round. Heat from the oven maintains the applicator at a temperature sufficient to melt a solventless enamel, but a small thermostatically controlled auxiliary heater (not shown) is fitted so that an appropriate application temperature can be maintained. From the oven, the wire passes round a bottom pulley 6 and returns in a vertical run 7 behind the oven to another top pulley 2; the process is repeated until the required number of coats of enamel have been applied, emerging at an outlet pulley 8 (for example).

I claim:

1. A wire enamelling machine comprising an oven, an applicator comprising at least one applicator unit mounted at the top end of the oven and forming part of a closure for the top end of the baking chamber of the oven, and means for passing the wire at least once downwardly through the applicator unit and the oven.

2. A machine as claim in claim 1 in which the applicator unit forms part of a closure for the top end of the baking chamber of the oven.

3. A machine comprising an oven, at least one applicator comprising a plurality of applicator units mounted at the top end of the oven and means including a set of top pulleys mounted adjacent the upper end of the oven and a set of bottom pulleys mounted adjacent the lower end of the oven for passing wire in a succession of downward passes through adjacent applicator units and on each downward pass through the oven.

4. A machine as claimed in claim 3 including applicator units and guide means for a number of wires extending parallel to one another.

5. A vertical enamelling machine comprising an oven, at least one applicator comprising a plurality of applicator units mounted in the top wall of the oven, and means including a set of top pulleys mounted above the oven and a set of bottom pulleys mounted below the oven for passing wire in a succession of vertical downward passes through adjacent applicator units and on each downward pass through the oven.

6. A machine as claimed in claim 1 including applicator units and guide means for a number of wires extending parallel to one another.

7. A machine as claimed in claim 5 including applicator units and guide means for a number of wires extending parallel to one another.

8. A machine as claimed in claim 1 in which each applicator unit includes a die removably mounted therein.

9. A machine as claimed in claim 5 in which each applicator unit includes a die removably mounted therein.

10. A machine as claimed in claim 8 in which the dies are mounted in one or more than one removable plate in the base of the applicator.

11. A machine as claimed in claim 9 in which the dies are mounted in one or more than one removable plate in the base of the applicator.

12. A machine as claimed in claim 1 including at least one further applicator positioned below the bottom of the oven to coat on at least one upward pass of the wire, the said upward pass also extending through a baking chamber of the oven.

13. A machine as claimed in claim 5 including at least one further applicator positioned below the bottom of the oven to coat on at least one upward pass of the wire, the said upward pass also extending through a baking chamber of the oven.

14. A method of enamelling wire comprising passing it downwardly in succession through a plurality of applicator units mounted at the top end of an oven and thence downwards through the oven, enamel being applied in a liquid condition in the applicator unit and cured to a solid condition in the oven.

15. A method as claimed in claim 14 in which enamel is applied in a liquid condition in the applicator unit and cured to a solid condition in the oven.

16. A method as claimed in claim 14 in which solventless enamel is applied in a liquid condition in the applicator unit and cured to a solid condition in the oven.

17. A method as claimed in claim 14 in which wire passes vertically downwardly through at least one applicator unit mounted at the top end of an oven and thence vertically downwards through the oven, enamel being applied in a liquid condition in the applicator unit and cured to a solid condition in the oven.

18. A method as claimed in claim 14 in which wire passes vertically downwardly through at least one applicator unit mounted at the top end of an oven as part of a closure for the top end of the baking chamber of the oven and thence vertically downwards through the oven, soventless enamel being applied in a liquid condition in the applicator unit and cured to a solid condition in the oven.

* * * * *